US005927219A

United States Patent [19]

Beyer

[11] Patent Number: 5,927,219

[45] Date of Patent: Jul. 27, 1999

[54] SINKER WITH MODULES FOR TUFTING TOOLS

[75] Inventor: Walter Beyer, Eschweiler, Germany

[73] Assignee: Jos. Zimmermann GmbH & Co. KG, Germany

[21] Appl. No.: 08/945,684

[22] PCT Filed: Apr. 17, 1996

[86] PCT No.: PCT/DE96/00666

§ 371 Date: Oct. 28, 1997

§ 102(e) Date: Oct. 28, 1997

[87] PCT Pub. No.: WO96/34139

PCT Pub. Date: Oct. 31, 1996

[30] Foreign Application Priority Data

Apr. 28, 1995 [DE] Germany ..... 295 06 819 U

[51] Int. Cl.[6] ..... D05C 11/04

[52] U.S. Cl. ..... 112/80.45

[58] Field of Search ..... 112/80.45, 80.4, 112/80.6

[56] References Cited

U.S. PATENT DOCUMENTS

| | | | |
|---|---|---|---|
| 4,157,690 | 6/1979 | Lund et al. | 112/80.45 X |
| 4,159,326 | 6/1979 | Green et al. | 112/80.45 |
| 4,509,439 | 4/1985 | Densmore et al. | 112/80.45 |
| 5,158,028 | 10/1992 | Beyer | 112/80.45 |
| 5,400,727 | 3/1995 | Neely | 112/80.45 |

*Primary Examiner*—Ismael Izaguirre

*Attorney, Agent, or Firm*—David C. Purdue; John C. Purdue

[57] ABSTRACT

An improved sinker and tufting tool module combination. The sinker, especially a needle sinker, is provided with a horizontally extending groove and a threaded bore. The tufting tool module, especially a needle module, has tools secured to a lower edge thereof and is provided with a through bore for receiving a securing screw. The module has a first, sinker facing surface and on that surface, there is provided a moulding which extends perpendicularly from that surface and engages the groove in the sinker. The module is supported on the sinker so that it can be pivoted about an axis running in the longitudinal direction of the sinker. Devices are provided for locking the module to the sinker in a desired angular position. By this arrangement, the position of the module can be adjusted, slightly, so that it may be precisely adapted to prevailing conditions.

18 Claims, 5 Drawing Sheets

SINKER WITH MODULES FOR TUFTING TOOLS

BACKGROUND OF THE INVENTION

1. Field of the Invention

The invention relates to a sinker with modules for tufting tools, especially a needle sinker with needle modules, in which the tufting tools are cast at one end into a plate-like basic module component, the length of which corresponds to a multiple of the centre-to-centre distance of the cast-in tufting tools and which has at least one through-drilling, through which a securing screw can pass and be screwed into the sinker.

2. Description of the Prior Art

It is known to cast a row of tufting, knitting or Raschel tools, for example needles or grippers, at exact locations into a basic module body and subsequently secure the modules, consisting of the tools and the basic module body, to a sinker, for example the needle sinker of a tufting machine. To fix it to the sinker, the basic module body is provided with a drilling, through which a screw is led. A corresponding threaded hole is provided in the sinker. In addition, a rectangular stop strip may be formed on the basic module body, the said stop strip being intended to fix the module in the direction of the sinker and transmitting the force acting in the direction of the tools from the module to the sinker.

A row of modules can thus be mounted on a sinker which may, if appropriate, have a length of up to 5 m. In view of the existing tolerances, a slight offsetting of the tools relative to one another often occurs in the plane of the tools. The tools are then not arranged exactly in a row, thus leading to an irregular fabric pattern in the tufting fabric produced.

SUMMARY OF THE INVENTION

The object on which the invention is based is to design the modules or the sinkers in such a way that a slight adjustment of the tool plane in relation to the sinker is possible.

The object is achieved, according to the invention, in that a horizontal groove is worked in the sinker, and in that there is formed on that side surface of the basic component of each module which faces the sinker at least one moulding which projects perpendicularly to this surface and which engages into the groove of the sinker so as to be pivotable about an axis running in the longitudinal direction of the sinker, and in that means are provided, by which the module is locked to the sinker in the angular position provided.

The arrangement may be designed, in a manner according to the invention, such that the means for locking the module are pressure screws which are located in the upper region of the module, pass through the module and are supported against the sinker.

The arrangement may also be designed, in a manner according to the invention, such that the imaginary centre point of the threaded hole for the securing screw is located on the imaginary centre line of the groove, the drilling in the basic component of the module tapers conically on both sides, and a moulded disc arranged under the screw head serves as a means for locking the module.

The arrangement may also be designed, in a manner according to the invention, such that the moulding is designed with a cross-section which is semicircular or in the form of a segment of a circle.

The arrangement may also be designed, in a manner according to the invention, such that the moulding is designed with a cross-section which is rectangular with a top semicircle.

The arrangement may also be designed, in a manner according to the invention, such that the groove is designed with a cross-section which is semicircular or in the form of a segment of a circle.

The arrangement may also be designed, in a manner according to the invention, such that the groove is designed with a cross-section which is triangular.

The arrangement may also be designed, in a manner according to the invention, such that the groove is designed with a cross-section which is trapezoidal.

The arrangement may also be designed, in a manner according to the invention, such that the moulding or mouldings is or are formed on both sides of the module.

The arrangement may also be designed, in a manner according to the invention, such that the moulding or mouldings is or are formed on the module by the injection-moulding process.

The arrangement may also be designed, in a manner according to the invention, such that the groove is milled out.

The advantage of the invention is that the modules can be adjusted in one direction and, nevertheless, are permanently fixed while the arrangement is in operation.

The invention will be explained in more detail by means of several exemplary embodiments described below and illustrated in the accompanying drawings.

BRIEF DESCRIPTION OF THE DRAWING FIGURES

FIG. 1 is a side view of a needle module according to the invention having an associated needle sinker, FIG. 2 is a front view of the arrangement according to FIG. 1, FIG. 3 is a side view of the arrangement according to FIG. 1 with strips formed on the needle module on both sides, FIG. 4 is a front view of the arrangement according to FIG. 3, FIG. 5 is a side view of a variant of the arrangement according to FIG. 1 with a modified shape of the groove of the needle sinker, FIG. 6 is a front view of the arrangement according to FIG. 5, FIG. 7 is a side view of the arrangement according to FIG. 5 with strips formed on the needle module on both sides, FIG. 8 is a front view of the arrangement according to FIG. 7, FIG. 9 is a side view of a further variant of the invention, FIG. 10 is a front view of the arrangement according to FIG. 9.

DESCRIPTION OF THE PREFERRED EMBODIMENTS

Figure 2:
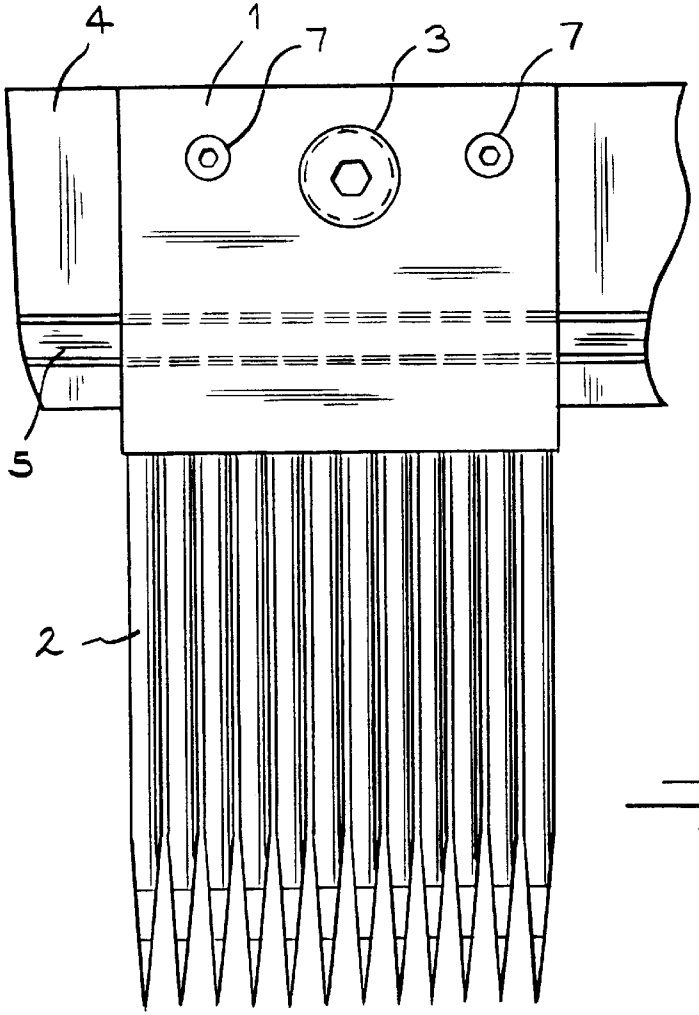

The module shown in the figures has a basic component 1, into which the tufting needles 2 are cast. The basic component 1 is provided with a drilling or bore. The module is secured go the needle sinker 4 through this drilling by means of a screw 3.

In conventional securing, the basic component 1 of the module would bear with the surface of one side on the needle sinker 4. By contrast, according to the invention, said basic component comes to bear only at a particular point. A groove 5 is worked into the needle sinker 4. The cross-section of the groove 5 is made trapezoidal in the embodiment shown in FIGS. 1 to 4. Located as a counterpiece on the basic component 1 of the needle module is a moulding which, in the exemplary embodiments, is designed as a moulded strip 6, the cross-section of which approximately corresponds, in the example according to FIG. 1, to a rectangle with a top semicircle. The module is consequently fixed in the vertical direction by the engagement of the moulded strip 6 in the groove 5. As indicated by the arrow, however, the said module is pivotable to a slight extent. The angle which the module forms with the needle sinker 4 is fixed by means of pressure screws 7 which are arranged in the upper region of the basic component 1 and which is U-shaped and are supported against the needle sinker 4. The angle of the needle module relative to the needle sinker 4 can thereby be adjusted approximately through 1 to 2°. The securing screw 3 is subjected to tensile stress correspondingly. When the needle module is readjusted, therefore, the securing screw 3 must, if appropriate, be loosened somewhat before the pressure screws 7 are tightened further.

Figure 1:
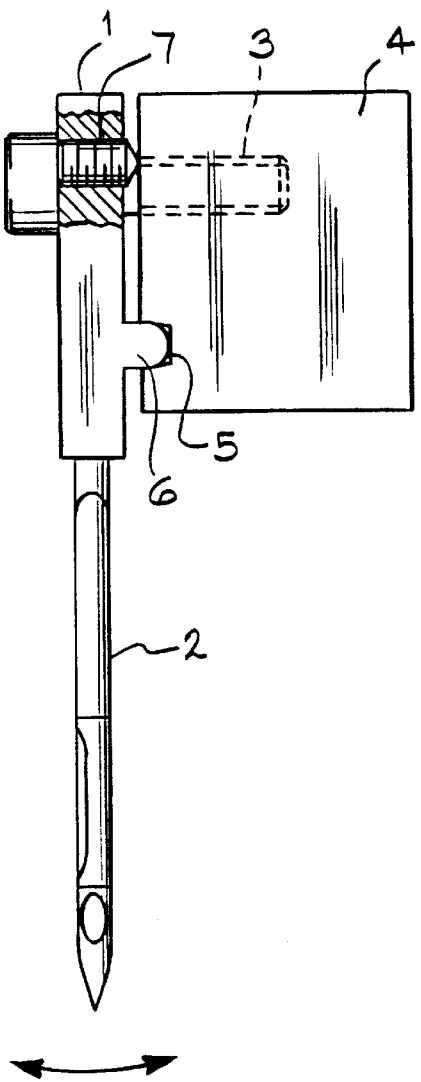
Figure 4:
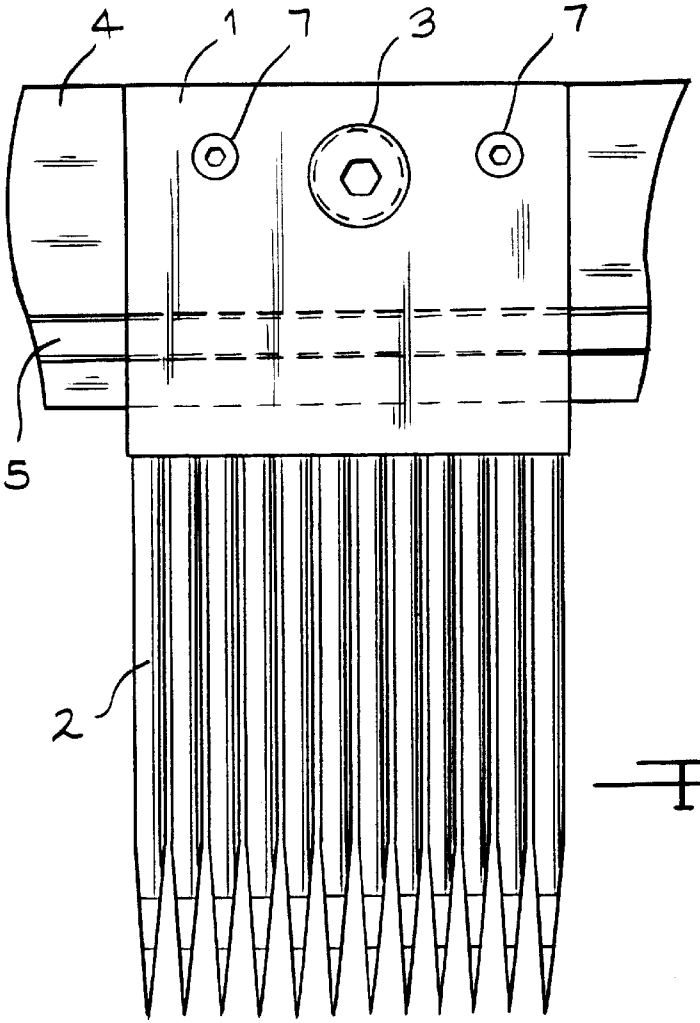
Figure 3:
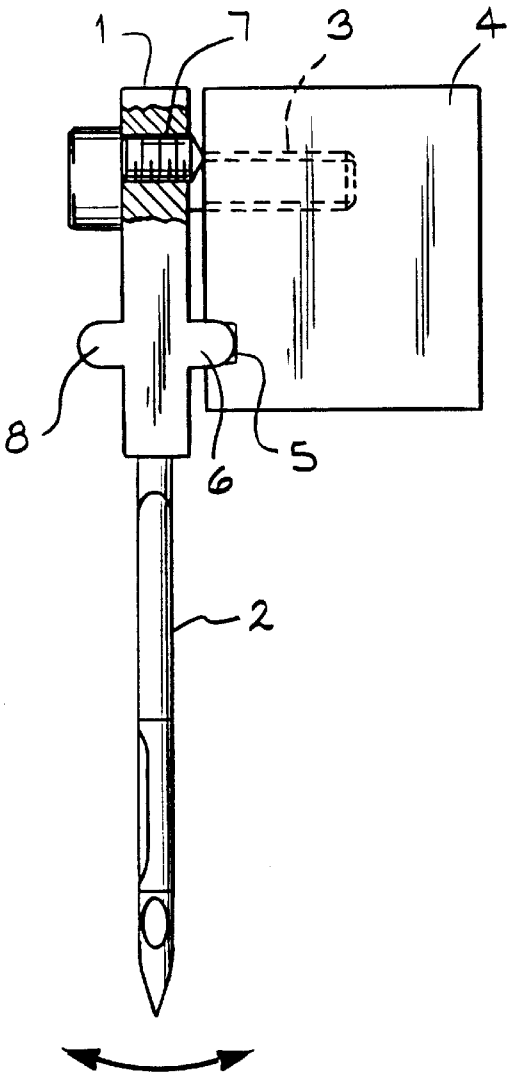
Figure 6:
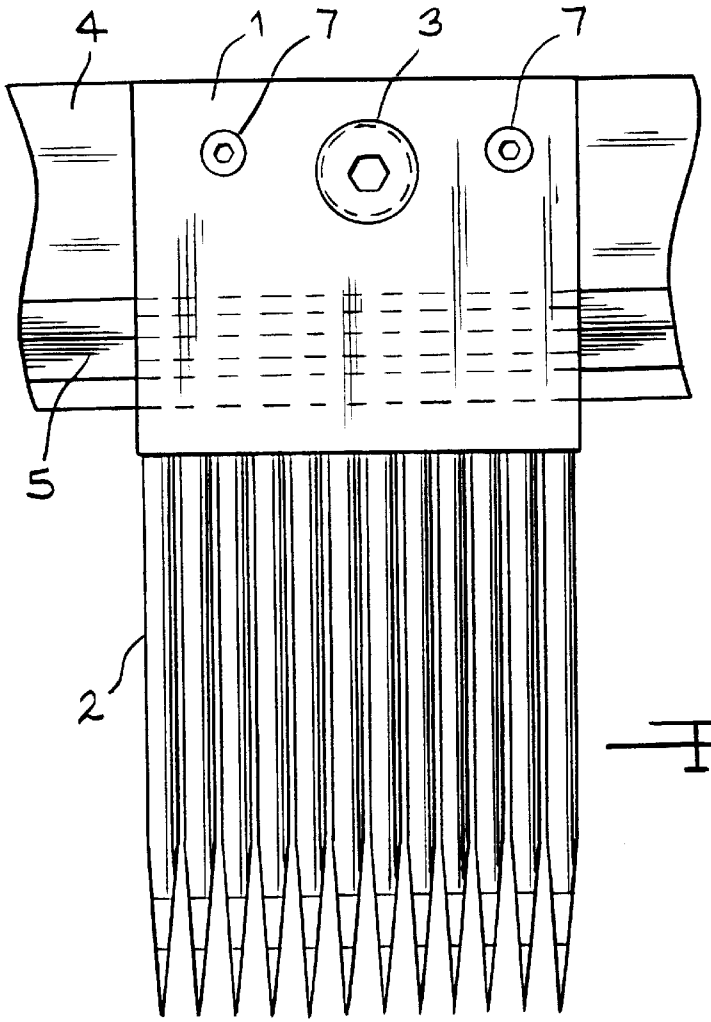

FIGS. 3 and 4 show an embodiment corresponding to that of FIG. 1, a further moulded strip 8 being formed on the opposite side of the basic component 1. The module can thus also be secured in the needle sinker 4 in a position rotated through 180°, the position of the tufting needles 2 changing at the same time.

Figure 5:
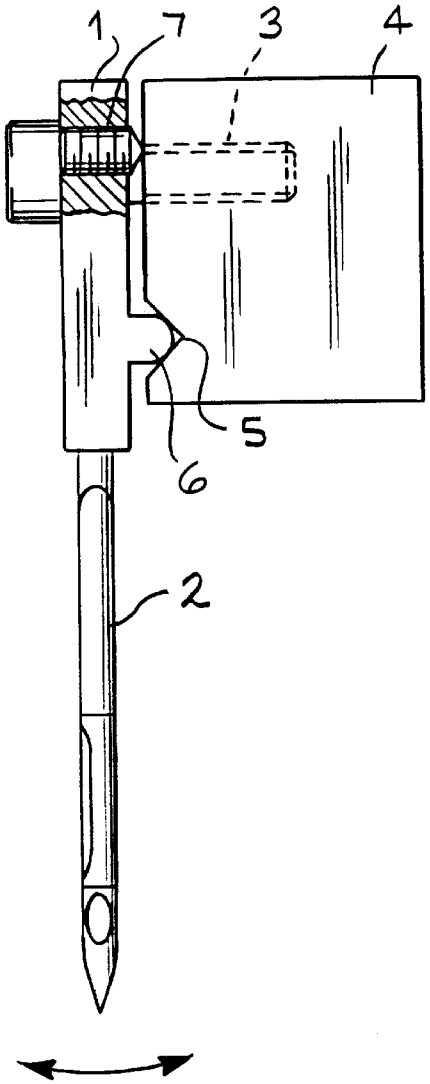
Figure 8:
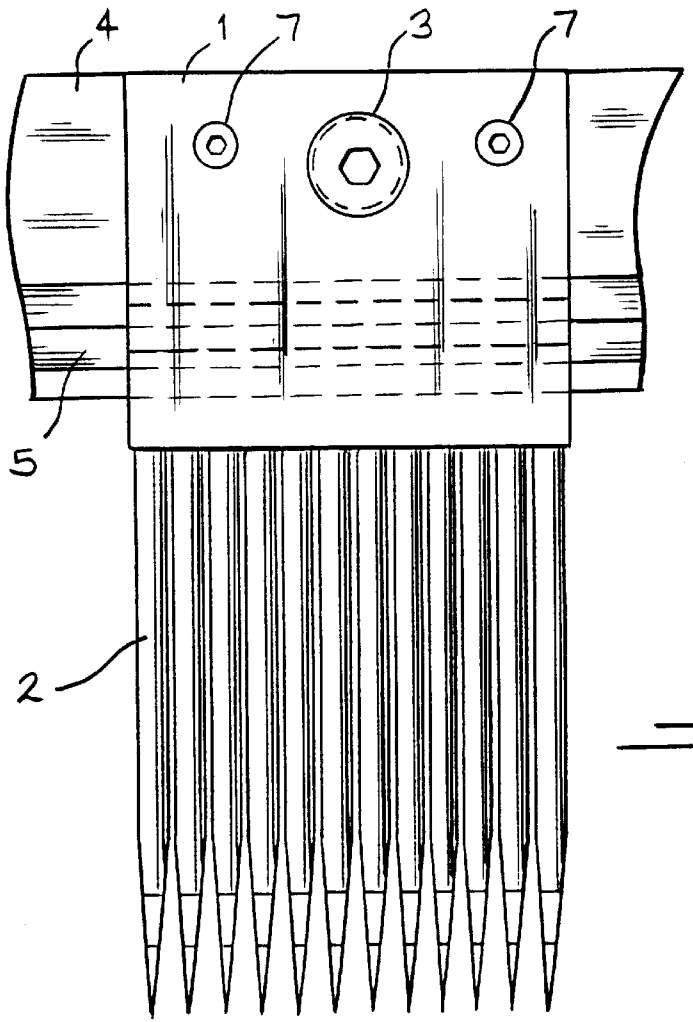
Figure 7:
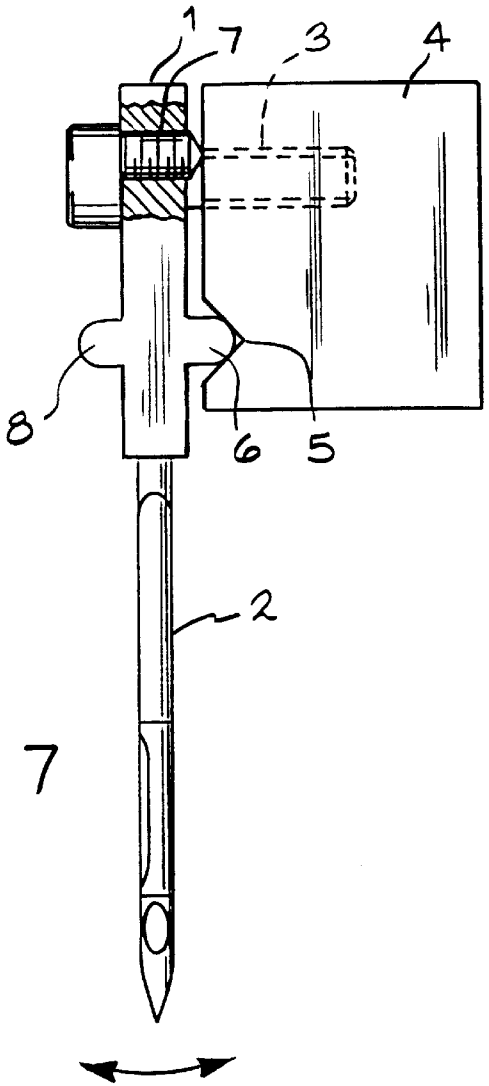
Figure 10:
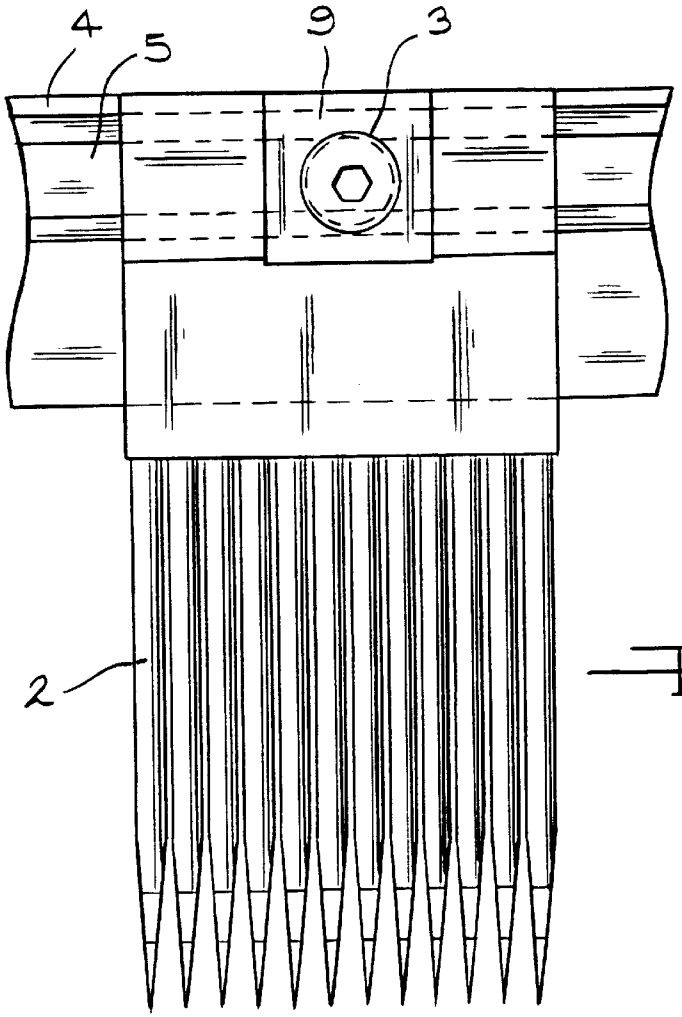

FIG. 5 shows a further embodiment of the invention, the groove in the needle sinker 4 being designed with a V-shaped or triangular cross-section. FIGS. 7 and 8 show this variant, once again with a needle module having moulded strips 6 and 8 formed on both sides.

Figure 9:
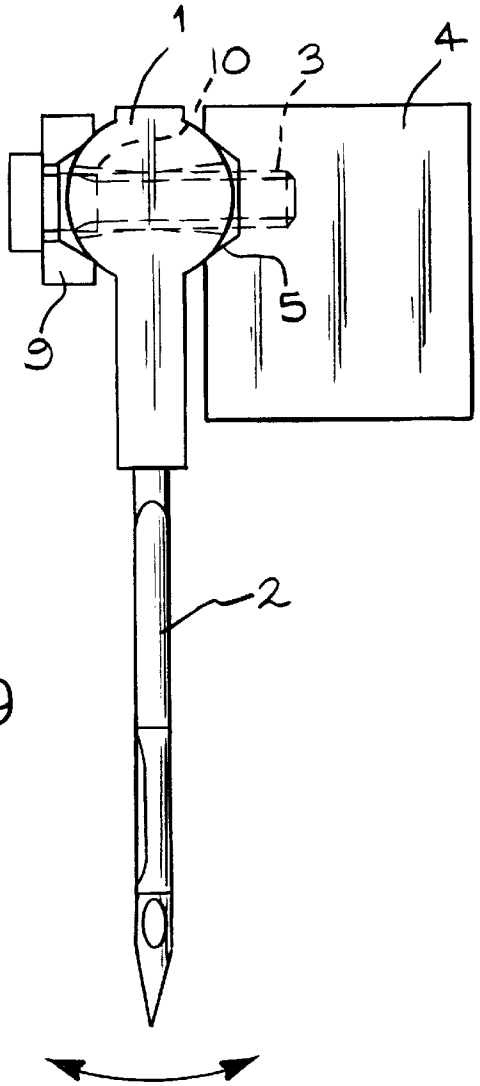

FIG. 9 shows an embodiment, in which the groove runs level with the threaded blind hole for the securing screw 3. The groove is defined by surfaces which, in cross section, are three legs for a trapezoid and the groove has a trapezoidal cross-section, and the associated moulded strip 6 in the basic component 1 of the needle module has a cross-section in the form of a segment of a circle. The drilling 10 in the basic component 1 is widened conically outwards in both directions in the manner of the eye of a hammer. This affords some angular moveability of the module relative to the sinker. The module is locked by means of a moulded disc 9 which is placed under the head of the securing screw 3 and which retains the module non-positively when the securing screw 3 is tightened.

The embodiments described have been illustrated and described solely in conjunction with tufting needles. Instead of needles, however, the arrangement may also extend to other tools, for example loopers and grippers.

I claim:

1. In combination, a sinker and tufting tool modules, said sinker having a module facing surface, a threaded bore extending through said surface and into said sinker, and a horizontally extending groove formed in said sinker, said tufting tool modules comprising a basic module, tufting tools supported in said basic module and extending from a first, lower edge thereof, a first, sinker facing, side surface on said basic module, a securing screw bore extending through said surface and said basic module through which a securing screw may extend and engage the threaded bore in said sinker and a first moulding which extends perpendicularly from said first, sinker facing, side surface and which, when said module is secured to said sinker by a securing screw passing through the securing screw bore and screwed into said sinker, engages the groove in said sinker so that said module is pivotable about an axis running in the longitudinal direction of said sinker between a first angular position and a second angular position, and means for locking said modules in a plurality of angular positions between said first and second positions.

2. The sinker and tufting tool modules claimed in claim 1 wherein said sinker is a needle sinker and said tufting tool modules are needle modules.

3. The sinker and tufting tool modules claimed in claim 1 wherein said means for locking said modules include pressure screws. wherein pressure screw bores are provided in said basic modules, near a second, upper edge thereof, and wherein said pressure screws are operable to engage said module facing surface of said sinker.

4. The sinker and tufting tool modules claimed in claim 1 wherein an imaginary centre point of the threaded bore in said sinker coincides with the imaginary centre line of the groove formed in said sinker, wherein the securing screw bore in said module tapers outwardly so that it is larger in diameter at both of its ends than it is in its middle, and wherein said means for locking said modules includes a moulded disc to be positioned between a head of a securing screw and said basic module.

5. The sinker and tufting tool modules claimed in claim 2,3, or 4 wherein the perpendicularly extending moulding of each module has an outer surface which, in cross section, is semicircular or includes another segment of a circle.

6. The sinker and tufting tool modules claimed in claim 5 wherein the groove formed in the sinker is defined by surfaces which, in cross section, a V-shaped.

7. The sinker and tufting tool modules claimed in claim 5 wherein the groove formed in the sinker is defined by surfaces which, in cross section, are three legs of a trapezoid.

8. The sinker and tufting tool modules claimed in claim 5 wherein said basic module further comprises a second moulding which extends perpendicularly from a second, sinker facing, side surface of said basic module, which is opposite said first, sinker facing, side surface.

9. The sinker and tufting tool modules claimed in claim 2,3, or 4 wherein the perpendicularly extending moulding of each module has an outer surface which, in cross section is U-shaped.

10. The sinker and tufting tool modules claimed in claim 9 wherein the groove formed in the sinker is defined by surfaces which, is defined by surfaces which, in cross section, are V-shaped.

11. The sinker and tufting tool modules claimed in claim 9 wherein the groove formed in the sinker is defined by surfaces which, in cross section, are three legs of a trapezoid.

12. The sinker and tufting tool modules claimed in claim 9 wherein said basic module further comprises a second moulding which extends perpendicularly from a second, sinker facing, side surface of said basic module, which is opposite said first, sinker facing, side surface.

13. The sinker and tufting tool modules claimed in claim 2, 3, or 4 wherein the groove formed in the sinker is defined by surfaces which, in cross section, are V-shaped.

14. The sinker and tufting tool modules claimed in claim 13 wherein said basic module further comprises a second moulding which extends perpendicularly from a second, sinker facing, side surface of said basic module, which is opposite said first, sinker facing, side surface.

15. The sinker and tufting tool modules claimed in claim 2,3, or 4 wherein the groove formed in the sinker is defined by surfaces which, in cross section, are three legs of a trapezoid.

16. The sinker and tufting tool modules claimed in claim 15 wherein said basic module further comprises a second moulding which extends perpendicularly from a second, sinker facing, side surface of said basic module, which is opposite said first, sinker facing, side surface.

17. The sinker and tufting tool modules claimed in claim 2,3, or 4 wherein said basic module further comprises a second moulding which extends perpendicularly from a second, sinker facing, side surface of said basic module, which is opposite said first, sinker facing, side surface.

18. The sinker and tufting tool modules claimed in claim 6,10,7, or 11, wherein said basic module further comprises a second moulding which extends perpendicularly from a second, sinker facing, side surface of said basic module, which is opposite said first, sinker facing, side surface.

* * * * *